US009816671B2

(12) United States Patent
Takamitsu

(10) Patent No.: US 9,816,671 B2
(45) Date of Patent: Nov. 14, 2017

(54) LIGHTING DEVICE WITH BROAD LIGHT DISTRIBUTION

(75) Inventor: Taro Takamitsu, Kakegawa (JP)

(73) Assignee: Ledvance GmbH (DE)

( * ) Notice: Subject to any disclaimer, the term of this patent is extended or adjusted under 35 U.S.C. 154(b) by 52 days.

(21) Appl. No.: 14/236,911

(22) PCT Filed: Aug. 1, 2012

(86) PCT No.: PCT/EP2012/065003

§ 371 (c)(1),
(2), (4) Date: May 7, 2014

(87) PCT Pub. No.: WO2013/020865

PCT Pub. Date: Feb. 14, 2013

(65) Prior Publication Data

US 2014/0247601 A1 Sep. 4, 2014

(30) Foreign Application Priority Data

Aug. 5, 2011 (JP) ..... 2011-171955

(51) Int. Cl.

| | |
|---|---|
| ***F21V 15/00*** | (2015.01) |
| ***F21K 99/00*** | (2016.01) |
| ***F21V 19/00*** | (2006.01) |
| ***F21V 29/70*** | (2015.01) |
| ***F21K 9/23*** | (2016.01) |

(Continued)

(52) U.S. Cl.

CPC ..... *F21K 9/1355* (2013.01); *F21K 9/23* (2016.08); *F21K 9/232* (2016.08); *F21V 19/005* (2013.01); *F21V 29/70* (2015.01); *F21V 3/00* (2013.01); *F21V 3/049* (2013.01); *F21V 3/0472* (2013.01); *F21V 29/89* (2015.01); *F21Y 2107/90* (2016.08); *F21Y 2115/10* (2016.08)

(58) Field of Classification Search

CPC ..... F21Y 2101/02; F21Y 2105/001; F21Y 2101/00; F21V 3/00

USPC ..... 362/362, 363, 382

See application file for complete search history.

(56) References Cited

U.S. PATENT DOCUMENTS 5,929,788 A * 7/1999 Vukosic ..... 362/297
6,220,722 B1 * 4/2001 Begemann ..... F21V 29/67 362/231

(Continued)

FOREIGN PATENT DOCUMENTS

JP 2001243807 A 9/2001
JP 2004269245 A 9/2004

(Continued)

OTHER PUBLICATIONS

International Search Report of PCT/EP2012/065003 dated Nov. 2, 2012, 3 Pages.

*Primary Examiner* — William Carter
(74) *Attorney, Agent, or Firm* — Hayes Soloway PC

(57) ABSTRACT

A lighting device may include: a board having a front surface and a back surface, and a board attachment base provided with an attachment surface smaller than the area of the back surface, an opposing surface larger than the area of the attachment surface and which opposes the attachment surface, and a lateral surface which extends out from the periphery of the attachment surface towards the periphery of the attachment surface, the board having a light source mounted in a section of the back surface region which is not abutted by the attachment surface.

7 Claims, 5 Drawing Sheets

(51) Int. Cl.

| | |
|---|---|
| ***F21K 9/232*** | (2016.01) |
| *F21V 3/00* | (2015.01) |
| *F21V 3/04* | (2006.01) |
| *F21V 29/89* | (2015.01) |
| *F21Y 115/10* | (2016.01) |
| *F21Y 107/90* | (2016.01) |

(56) References Cited

U.S. PATENT DOCUMENTS

| | | | | |
|---|---|---|---|---|
| 2004/0175221 | A1 | 9/2004 | Sekino | |
| 2007/0103901 | A1 | 5/2007 | Reid | |
| 2010/0039816 | A1 | 2/2010 | Yeh | |
| 2012/0327670 | A1* | 12/2012 | Pickard | F21K 9/137 362/373 |

FOREIGN PATENT DOCUMENTS

| | | | |
|---|---|---|---|
| JP | 2008103112 | A | 5/2008 |
| JP | 2009004130 | A | 1/2009 |
| JP | 2010129300 | A | 6/2010 |
| JP | 2010157459 | A | 7/2010 |
| WO | 2005108853 | A1 | 11/2005 |
| WO | 2011078485 | A2 | 6/2011 |

* cited by examiner

LIGHTING DEVICE WITH BROAD LIGHT DISTRIBUTION

RELATED APPLICATIONS

The present application is a national stage entry according to 35 U.S.C. §371 of PCT application No.: PCT/EP2012/065003 filed on Aug. 1, 2012, which claims priority from Japanese application No.: 2011-171955 filed on Aug. 5, 2011, and is incorporated herein by reference in its entirety.

TECHNICAL FIELD

Various embodiments relate to a lighting device which employs a light-emitting diode.

BACKGROUND

Various improvements have contributed to realizing an LED bulb with a broad light distribution close to that of an incandescent bulb.

SUMMARY

Various embodiments provide a lighting device with a broad light distribution.

The lighting device of the disclosure includes a board having a front surface and a back surface, and a board attachment base provided with an attachment surface smaller than the area of the back surface, an opposing surface larger than the area of the attachment surface and which opposes the attachment surface, and a lateral surface which extends out from the periphery of the attachment surface and faces the periphery of the attachment surface, the board having a light source mounted in a section of the back surface region which is not abutted by the attachment surface.

The attachment surface is abutting the central region of the back surface, and the light source being mounted so as to surround the central region.

The lighting device further includes a translucent globe which covers the board attachment base and the board attached to the board attachment base, the lateral surface of the board attachment base being a reflective surface which reflects the light emitted by the light source through the globe.

The globe has cross sections through surfaces parallel to the attachment surface are annular, the board being attached to the same surface as the maximum cross sectional diameter, this being the cross section through the globe with the largest diameter.

The lateral surface of the board attachment base has a tapered shape.

The board attachment base is configured such that the angle between the opposing surface and the lateral surface is between 40° and 60°.

The lateral surface of the board attachment base is a concave surface.

The attachment surface, opposing surface and board are circular in shape, the radius of the board having a length of between ½ and ¾ of the radius of the opposing surface, and the radius of the attachment surface having a length of between ½ and ¾ of the length of the radius of the board.

With the lighting device of the disclosure, the provision of a front surface and a back surface, an attachment surface with an area smaller than the back surface, an opposing surface which faces the attachment surface and has an area larger than the attachment surface, and a lateral surface which extends out from the periphery of the attachment surface toward the periphery of the attachment surface, and the provision of a board attachment base to which the board is attached, abutting the attachment surface against the back surface, means that as the board is mounted with a light source in a section of the back surface region not abutted by the attachment surface, there is the effect that light emitted from the light source mounted on the back surface is reflected by the lateral surface allowing a light distribution of greater than 180° to be realized over this opposing surface.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Embodiment 1

Figure 1:
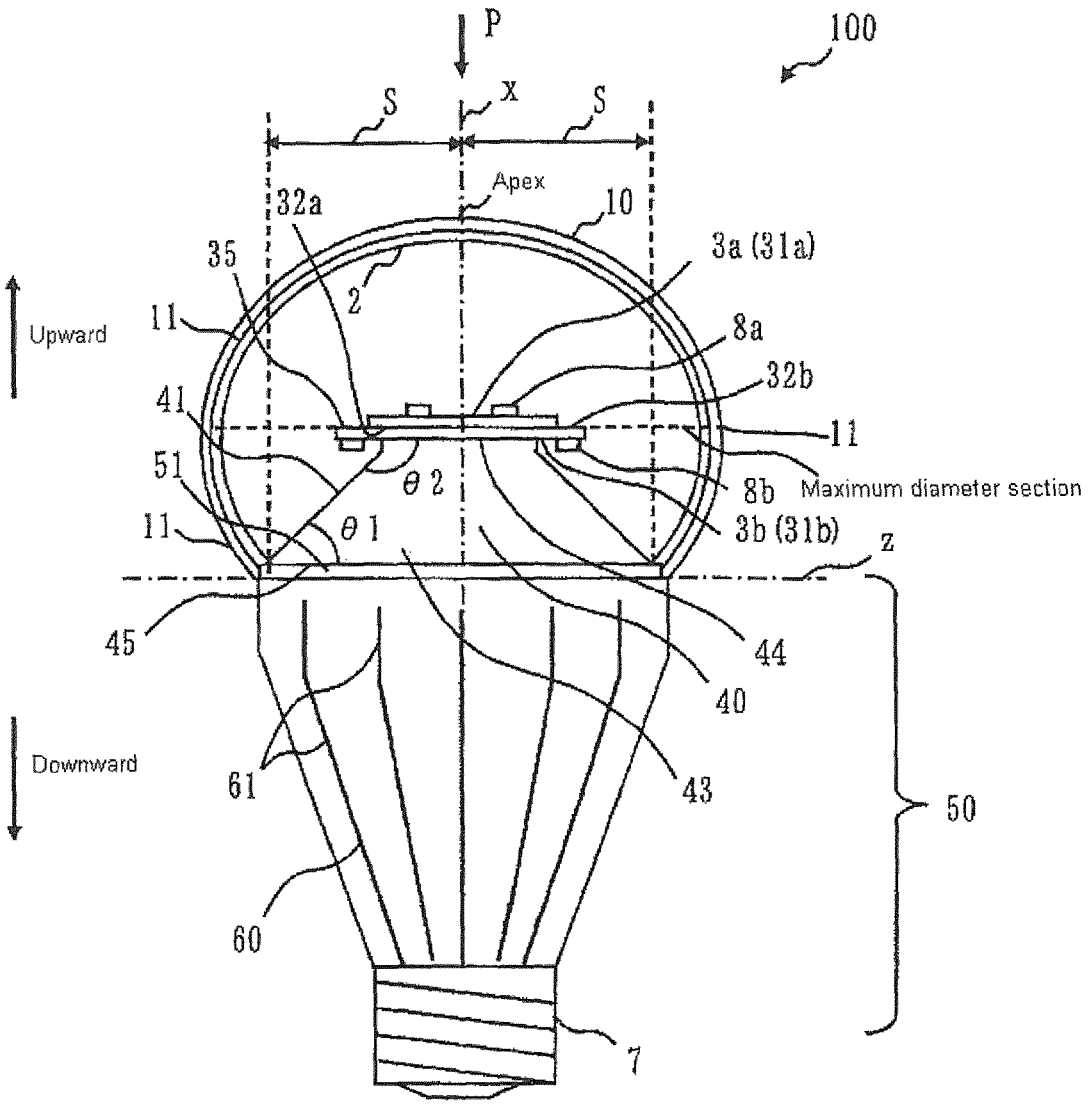
FIG. 1 shows a structural diagram of lighting device 100 of Embodiment 1.
Figure 2:
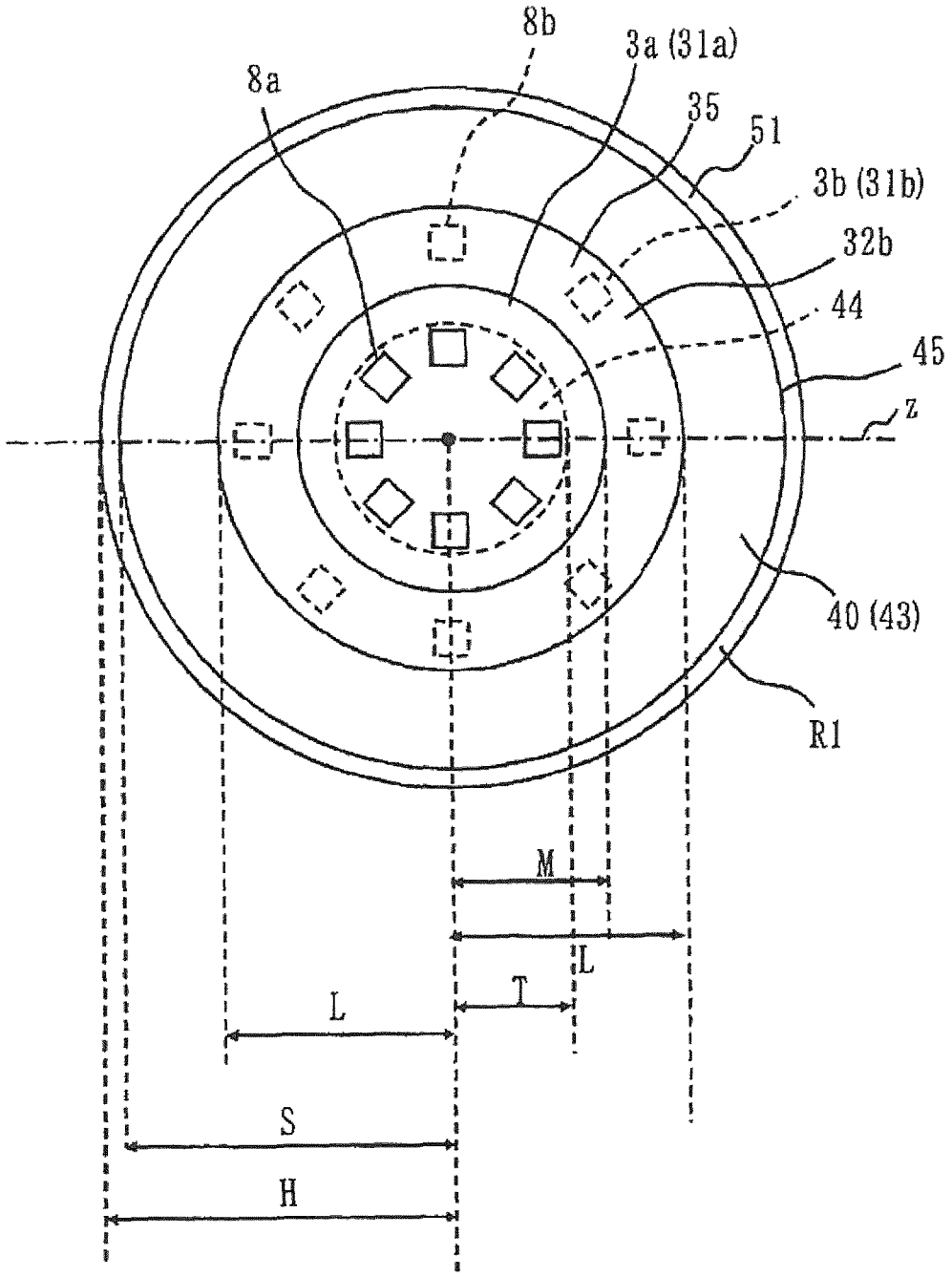
FIG. 2 shows a plan view of lighting device 100 in Embodiment 1 with translucent globe 10 removed.
Figure 3:
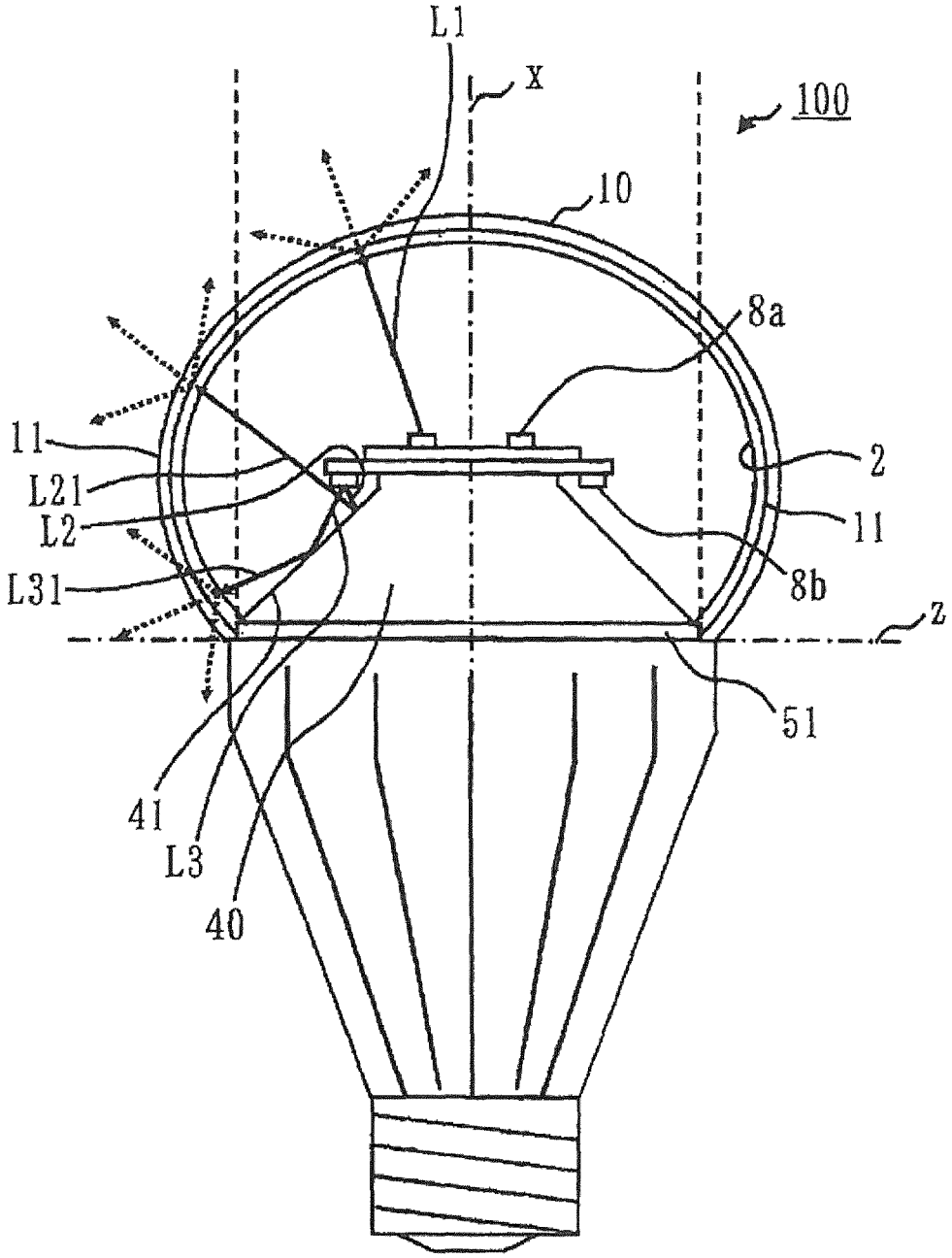
FIG. 3 shows a schematic diagram of the light paths of lighting device 100 in Embodiment 1.

(1) First Embodiment (FIG. 1, FIG. 2, FIG. 3)

FIG. 1 is a structural diagram of lighting device 100 in Embodiment 1. FIG. 2 is a plan diagram showing lighting device 100 in Embodiment 1 with translucent globe 10 removed (seen from direction P in FIG. 1). FIG. 3 is a schematic diagram of the light paths of lighting device 100 in Embodiment 1. A description of the structure of lighting device 100 in Embodiment 1 will now be given using FIGS. 1-3.

As shown in FIG. 1, lighting device 100 in an embodiment of the disclosure is provided with fitting 7, outer surround 60, translucent globe 10, step section 40, and LED boards 3*a*, 3*b*. LED board 3 (3*a*, 3*b*) is mounted with LED element 8 (8*a*, 8*b*) on light-emitting surface 31 (31*a*, 31*b*).

With LED boards 3*a*, 3*b*, surfaces which are not light-emitting surfaces 31*a*, 31*b* (non-light-emitting surfaces 32*a*, 32*b*) are brought together and fixed to each other. LED boards 3*a*, 3*b* with surfaces which are not light-emitting surfaces 31*a*, 31*b* (non-light-emitting surfaces 32*a*, 32*b*) that are brought together and fixed to each other may be referred to as LED board 3. LED board 3 is an example of a board. Moreover, light-emitting surface 31*a* of LED board 3*a* is an example of the front surface of the board, and light-emitting surface 31*b* of LED board 3*b* is an example of the back surface of the board.

LED board 3 is positioned within an external container comprising polycarbonate translucent globe 10 which covers light-emitting surface 31 of LED board 3 on which LED element 8 is mounted, outer surround 60 and fitting 7. The lighting circuit board (not shown) which powers the LED is located within outer surround 60 which forms the external enclosure.

Main plane plate 51 which is the surface on the translucent globe 10 side of external surround 60 is made of aluminum. Main plane plate 51 is a flat surface which joins together translucent globe 10 and lighting device body 50.

Lighting device main body 50 comprises the lighting circuit board located within external surround 60, lighting surround 60, fitting 7, and main plane plate 51.

Translucent globe 10 is positioned to enclose both step section 40 to be described later, and LED board 3 which is attached to step section 40. Translucent globe 10 may for example be made of polycarbonate. Translucent globe 10 is provided with globe overhang section 11 which overhangs the outside over 360° beyond radius S (see FIG. 1) of the main plane plate.

The inside (inner surface) of translucent globe 10 is coated with a light-diffusing reflective agent such as titanic oxide which diffuses and reflects light, or a light-diffusing reflective agent, forming light-diffusing film 2. Light-diffusing film 2 may be formed of any material which reflects or diffuses light such as silica, alumina or the like. The resin may also be frosted, and a resin with an added light-diffusing agent may be used.

As described above, the outer enclosure comprises translucent globe 10, outer surround 60 and fitting 7. Outer surround 60 also functions as a heat dissipater made of aluminum which cools LED element 8, and is provided with a plurality of heat dissipaters 61.

LED boards 3*a*, 3*b* on which LED elements 8*a*, 8*b* are mounted are positioned within the external enclosure. Lighting circuit board (not shown) which powers the LED is positioned within outer surround 60 (heat dissipater) which forms the external enclosure.

With the surface of LED board 3 (3*a*, 3*b*) as the z direction, the central axis of lighting device 100 is the x direction.

x: perpendicular to the plane of LED board 3 (3*a*, 3*b*) (axis of lighting device)

z: horizontal to the plane of LED board 3 (3*a*, 3*b*)

The circular surface on the translucent globe 10 side of outer enclosure 60 (main plane plate 51) is made of aluminum. LED boards 3*a*, 3*b* on which LED elements 8*a*, 8*b* are mounted are provided on step section 40 (one example of the board attachment base) provided on main plane plate 51 of lighting device 100.

Step section 40 is provided with board attachment surface 44 (an example of the attachment surface) having an area smaller than light-emitting surface 31*b* (back surface of the board) of LED board 3*b*, and bottom section 45 (an example of an opposing surface) which is larger than the surface area of board attachment surface 44, bottom section 45 opposing board attachment surface 44. Step section 40 is also provided with lateral surfaces which extend in the direction of the periphery of bottom section 45 from the periphery of board attachment surface 44. Step section 40 is an example of the board attachment base to which LED board 3 is attached and in which board attachment surface 44 abuts light-emitting surface 31*b* (back surface of board) of LED board 3*b*.

LED board 3 has LED element 8*b* (the light source) mounted on a section of light-emitting surface 31*b* (back surface of board) of LED board 3*b* which does not abut board attachment surface 44.

As shown in FIG. 1, the lateral surface of step section 40 is a tapered surface 41 which extends in a tapered shape, and is a reflective surface which reflects the light emitted from LED element 8*b* through translucent globe 10.

Step section 40 has tapered surface 41 (one example of a lateral surface) which faces toward LED board 3 (3*a*, 3*b*) from main plane plate 51, and has a conical shape. Step section 40 is provided with tapered surface 41 (tapered section) which extends out in a tapered shape on the side opposite to translucent globe 10.

Step section 40 will be a thermally conductive resin of polybutylene terephthalate or the like. A light-diffusing agent is coated on the tapered surface 41 (tapered section) of step section 40.

As shown in FIG. 2, board attachment surface 44, bottom section 45, LED boards 3*a*, 3*b*, and main plane plate 51 are all circular in shape. The center of board attachment surface 44, the center of bottom section 45 LED Boards 3*a*, 3*b* and the center of main plane plate 51 are all aligned on top of one another. Board attachment surface 44 abuts against the central region of light-emitting surface 31*b* (back surface of the board) of LED board 3*b*, and LED elements 8*b* are mounted so as to surround the central region of light-emitting surface 31*b* (back surface of board) of LED board 3*b*.

As shown in FIG. 2, eight LED elements 8*b* are mounted near the periphery of light-emitting surface 31*b* so as to surround the region which abuts board attachment board 44. Moreover, eight LED elements 8*a* are mounted on light-emitting surface 31*a* of LED board 3*a* so as to surround the center of light-emitting surface 31*a* of LED board 3*a*.

Cross sections through translucent globe 10 parallel to the plane surface of board attachment surface 44 are annular. As shown in FIG. 1, LED board 3 is attached to the same surface as the part with the largest diameter where the diameter is greatest (known as the maximum diameter section) of the cross sections through translucent globe 10 in planes parallel to board attachment surface 44.

LED boards 3*a*, 3*b* are positioned so that line x which connects the center position of main plane plate 51 of lighting device 100 and the top of translucent globe 10 is at the center or close to the center of LED board 3*a*, 3*b*. Moreover LED boards 3*a*, 3*b* are positioned at the part where globe overhang section 11 has its maximum diameter.

As shown in FIG. 2, LED boards 3*a*, 3*b* are circular in shape, with a plurality of LED elements 8*a* (for example, eight) mounted on the front surface (light-emitting surface 31*a* of LED board 3*a*). Around the periphery (edge) of the back surface (light-emitting surface 31*b* of LED board 3*b*) are mounted a plurality of LED elements 8*b* (for example, eight) in a circular shape.

LED board 3 (3*a*, 3*b*) of this embodiment is made of aluminum. As shown in FIG. 1, by placing together non-light-emitting surface 32*a* of LED board 3*a* and non-light-emitting surface 32*b* of LED board 3*b*, a single metal LED board 3 can be manufactured. By placing together the non-light-emitting surfaces 32 of two boards (LED board 3*a*, LED board 3*b*), it is possible to position LED elements 8 on both surfaces.

The front surface of the board is the surface that faces upward, and is light-emitting surface 31*a* of LED board 3*a* and the portion of non-light-emitting surface 32*b* of LED board 3*b* which is visible protruding beyond it. Diameter M of LED board 3*a* (see FIG. 2) is smaller than diameter L (see FIG. 2) of the lower side surface that is the back surface of the board (light-emitting surface 31*b* of LED board 3*b*).

As shown in FIG. 2, radius L of LED board 3*b* is preferably from ½ to ¾ of the length of radius H of main plane plate 51. Radius L may be ⅔ the length of radius H. Moreover, radius L may be of a length other than from ½ to ¾ of the length of radius H.

As shown in FIG. 2, radius T of board attachment surface 44 is preferably of a length that is from ½ to ¾ of radius L of LED board 3*b*. Radius T may be of a length that is ⅔ of radius L. Moreover, radius T may be the length other than from ½ to ¾ of the length of radius L.

If the proportion of light-emitting surface 31*b* of LED board 3*b* occupied by board attachment surface 44 is too small, there is insufficient heat dissipation for LED board 3. Moreover, if the proportion of light-emitting surface 31*b* of LED board 3*b* occupied by board attachment surface 44 is too great, the area on which LED elements 8*b* can be mounted is too small, and sufficient light cannot be obtained.

It is moreover preferable that main plane plate 51 and bottom section 45 be approximately the same size. In FIG. 2, when seen from direction P of lighting device 100, main plane plate 51 is slightly larger by the amount of region R1. Translucent globe 10 is to be attached in this annular region R1, and as shown in FIG. 1, the region R1 is in fact hidden. Due to this all of the light emitted by LED elements 8*b* either passes directly through translucent globe 10 or is reflected by tapered surface 41 of step section 40 and passes through translucent globe 10, meaning that no light is wasted.

In FIG. 2, the circular region surrounded by the dotted line is the region where board attachment surface 44 of step section 40 and light-emitting surface 31*b* (back surface of board) of LED board 3*b* abut. As shown in FIG. 1 and FIG. 2, with LED board 3 (3*a*, 3*b*) LED elements 8*a* which shine light in the direction of translucent globe 10 (upwards (see FIG. 1)) from light-emitting surface 31*a* of LED board 3*a* are mounted on light-emitting surface 31*a* of LED board 3*a*. Moreover, LED elements 8*b* which shine light in the direction of main plane plate 51 from light-emitting surface 31*b* of LED board 3*b* are mounted on a section of light-emitting surface 31*b* of LED board 3*b* not abutted by board attachment surface 44.

The section of light-emitting surface 31*b* of LED board 3*b* not abutted by attachment surface 44 is designated as board overhang section 35 which overhangs the periphery of attachment surface board 44 of step section 40 (see FIG. 1, FIG. 2.) In other words, LED elements 8*b* which shine light in the direction of main plane plate 51 from light-emitting surface 31*b* of LED board 3*b* (downwards) are mounted on board overhang section 35.

The angle θ1 between tapered surface 41 of step section 40 and main plane plate 51 (z direction) is between 40 and 60°, and will optimally be between 40° and 50°. Moreover, the angle θ2 between tapered surface 41 of step section 40 and the LED board (z direction) will be between 140° and 120°, and optimally between 140° and 130°.

Angle θ1 between tapered surface 41 of step section 40 and main plane plate 51 (z direction) will optimally be at 45°, between 40° and 50°. Moreover, the angle θ2 between tapered surface 41 of step section 40 and the LED board (z direction) will optimally be at 135°, between 140° and 130°.

As described above, with lighting device 100 of the embodiment, the bonding of two LED boards 3*a*, 3*b* enables a single LED board 3 to be manufactured with LED elements 8 mounted on both surfaces. However, a board which has mounts on both sides may be used. In this case the area of board for a double-sided mounting must be designed to be the same as the area of LED board 3*b* (radius L).

Bottom section 45 (bottom surface) of step section 40 is attached to main plane plate 51. The area of bottom section 45 of step section 40 (radius S) is the same or slightly smaller than the area of main plane plate 51 (radius H). Tapered surface 41 (sloping surface) is formed from the top part of step section 40 (board attachment surface 44) toward bottom section 45 of step section 40, and bottom section 45 of step section 40 is attached to main plane plate 51.

Board overhang section 35 which overhangs from step section 40 is present on LED board 3 (3*b*). Board overhang section 35 is the part of light-emitting surface 31 (31*b*) of LED board 3 (3*b*) which protrudes around the periphery of board attachment surface 44 (top) of step section 40 over 360°.

LED elements 8*a* are mounted on the front surface (the light-emitting surface 31*a*) on the translucent globe 10 side (upper side) of LED board 3 (3*a*), with LED element 8*b* being mounted on the back surface (light-emitting surface 31*b* of LED board 3*b*) on the board overhang section 35 side (lower side) of step section 40 of LED board 3 (3*b*). In other words, LED elements 8 are mounted on both sides of LED board 3.

A schematic diagram of the light paths for the LED elements 8 positioned on both surfaces of LED board 3 in this embodiment are shown in FIG. 3.

Light LI emitted from LED element 8*a* is transmitted directly to light-diffusing film 2 and translucent globe 10, and diffused by the light-diffusing effect of light-diffusing film 2 and translucent globe 10 to shine out externally.

Light L2 emitted from LED element 8*b* is transmitted to tapered surface 41 of step section 40 and reflected to light path L21. Light L21 reaches light-diffusing film 2 and translucent globe 10, and is diffused by the light-diffusing effect of light-diffusing film 2 and translucent globe 10 to shine out externally.

Light L3 emitted from LED element 8*b* reaches tapered surface 41 of step section 40 and is reflected to form light path L31. Light L31 reaches light-diffusing film 2 and translucent globe 10, and is diffused by the light-diffusing effect of light-diffusing film 2 and translucent globe 10 to shine out externally.

Globe overhang section 11, light-diffusing film 2 (light-diffusing reflective agent) or light-diffusing agent coated on the inside of translucent globe 10, and tapered step section 40 enable light from the LEDs positioned on both surfaces of the LED board to form the light paths shown in FIG. 3 described above, realizing light distribution over more than 180°, and allowing light distribution of much light in the z direction.

Lighting device 100 in the embodiment is provided with a board mounted with a light source, a heat dissipater which cools the lighting source, a lighting circuit board which powers the light source, and a translucent globe which covers the light-emitting surface of the light source, being characterized in that the light source is mounted on a board set on a step section provided on a plane surface of the lighting device which joins together the globe and the main body of the lighting device, the board having an overhang section which extends beyond the step section, a light source mounted both on the surface of the translucent globe side of the board and the surface of the step section side of the overhang section of the board. Thus with lighting device 100 of the embodiment, the mounting of a lighting source on the step section side of the overhang section enables light to be distributed over more than 180° in the plane formed by the abutment of translucent globe and the main body of the lighting device, with light also being reflected away from the translucent globe.

Lighting device 100 of the embodiment is characterized in that the board on which the light source is mounted is positioned near the center of the line connecting the center of the plane joining the globe and the main body of the lighting device with the apex of the globe. Thus with lighting device 100 of the embodiment, with the board on which the light source is mounted positioned in the center of the translucent globe, light can be radiated toward the base of the translucent globe as well, enabling light distribution over more than 180°.

Lighting device 100 of the embodiment is characterized in that the step section extends in a tapered shape away from the translucent globe. Thus with lighting device 100 of the embodiment, the fact that the step section extends in a tapered shape away from the translucent globe not only enables light to be distributed over more than 180° with light also shining towards the base of the translucent globe in the plane which joins it to the main body, but more light than is conventionally possible is distributed toward the plane.

Moreover, with the taper-shaped step section, the part above the plane which joins the translucent globe and the lighting device main body plays the role of a bridge which carries a board with a light source mounted on both sides, this taper-shaped step section also playing the role of a reflector which reflects the light source on the bottom surface of the board overhang section, and as the light source is mounted on the overhang section at a part other than the surface fixed to the step section of the lower board surface, and despite the fact that a light source is mounted on both surfaces, it is possible to fix the light source board simply and strongly to the step section, and moreover, as the step section also acts as a reflector, it is possible to provide a reflector below the board, thus realizing the light distribution described above.

Lighting device 100 of the embodiment is characterized in that the tapered surface of the tapered step section is a curved surface. Thus lighting device 100 of the embodiment, having the step section tapered as a curved surface reflects light, enables more light to be distributed in the direction of the plane.

Lighting device 100 of the embodiment is characterized in that the step section comprises a member which reflects light. Thus with lighting device 100 of the embodiment, it is possible to have more light distribution both toward the base of the translucent globe toward the plane because the tapered surface of the taper-shaped step section reflects light.

Lighting device 100 of the embodiment is characterized in that the step section comprises a member which diffuses light. Thus with lighting device 100 of the embodiment it is possible to have more light distribution both toward the board of the translucent globe toward the plane as the tapered surface of the taper-shaped step section diffuses light.

Lighting device 100 of the embodiment is characterized in that the front surface of the step section is made of metal which is polished and reflects light. Thus with lighting device 100 of the embodiment it is possible to have more light distribution both toward the board of the translucent globe both toward the plane by having the step section made of metal which is polished on its front surface and reflects light.

The lighting device 100 of the embodiment is characterized in that said step section also functions as a heat dissipater which cools the light source. Thus with lighting device 100 of the embodiment it is possible to have more effective heat dissipation for the light source by having the step section also function as a heat dissipater which cools the light source. Moreover, the same heat dissipation effect can be obtained even with a reduced amount of heat dissipation material.

Lighting device 100 of the embodiment is characterized in that a light source is positioned on both sides of the board by bringing together the bottom surfaces of two boards with a light source positioned on one side of each board respectively. Thus with lighting device 100 of the embodiment, it is possible to have a metal board with a light source positioned on both sides by joining together the bottom surfaces of two boards with a light source positioned on one side of each of the boards respectively.

Embodiment 2

Figure 4:
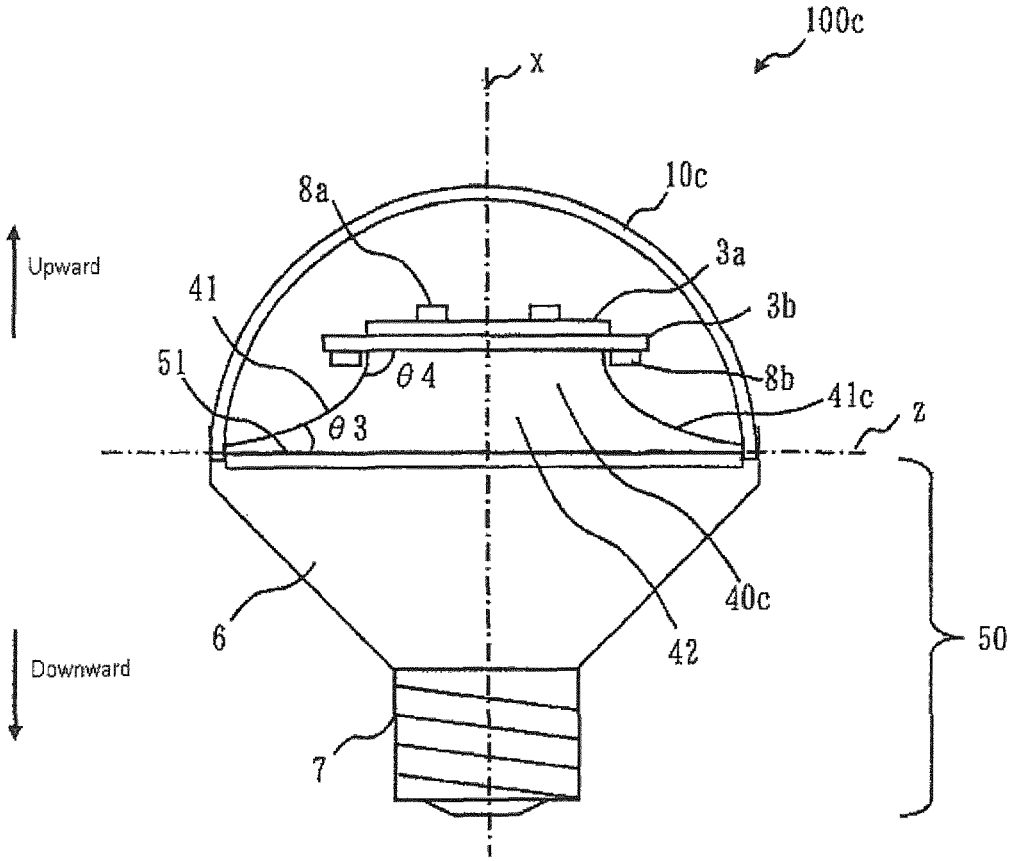
FIG. 4 shows a structural diagram of lighting device 100*c* in Embodiment 2.
Figure 5:
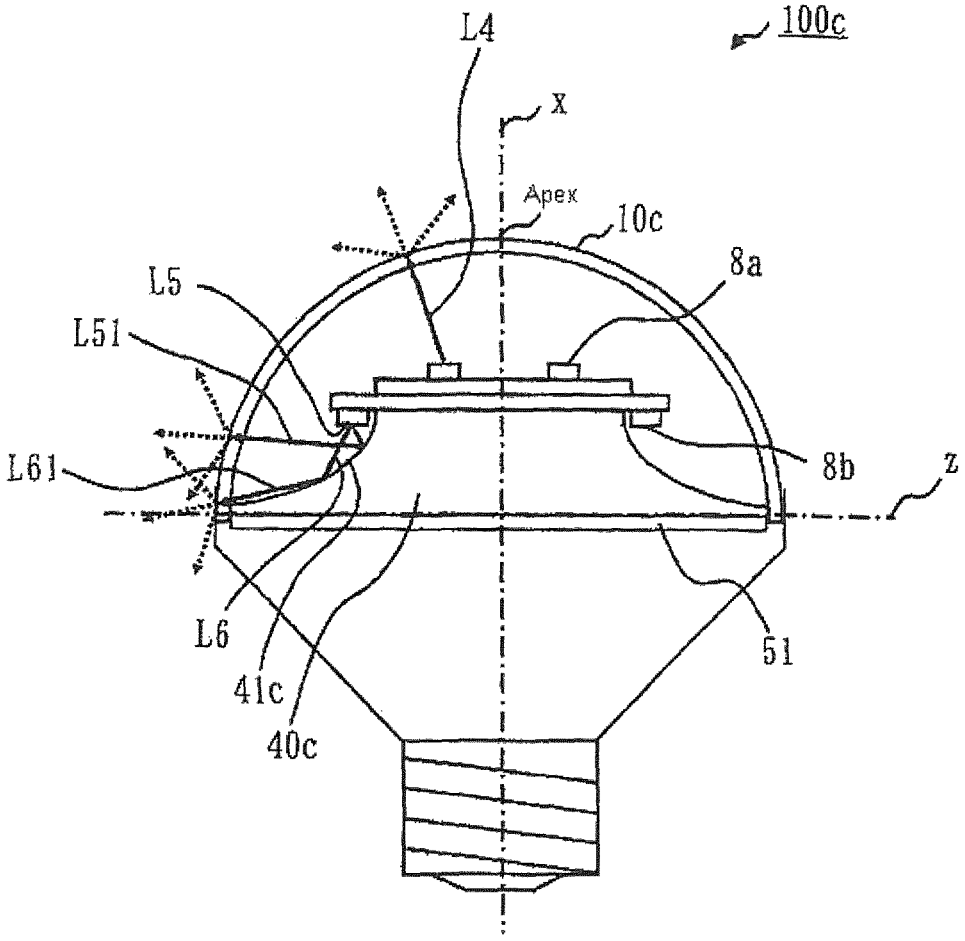
FIG. 5 shows a schematic diagram of the light paths in lighting device 100*c* in Embodiment 2.

(2) Second Embodiment (FIG. 4, FIG. 5)

FIG. 4 is a structural diagram of lighting device 100*c* in the embodiment. FIG. 5 is a schematic diagram showing the light paths for lighting device 100*c* in the embodiment.

The embodiment will be described below mainly with respect to points that differ from Embodiment 1. The points of difference between lighting device 100 in Embodiment 1 and lighting device 100*c* in this embodiment are mainly the shape of concave surface section 41*c* of step section 40*c*, and the shape of translucent globe 10*c*. All other structural parts are keyed identically and their description will be omitted.

Translucent globe 10*c* in this embodiment is a hemisphere. Translucent globe 10*c* has no globe overhang section 11 (see FIG. 1) extending outside of the diameter of main plane plate 51.

LED board 3 (3*a*, 3*b*) is positioned in or near the center of line x which connects the top of translucent globe 10*c* with the center of main plane plate 51 of lighting device 100*c*.

Step section 40*c* is made of aluminum, which also functions as an aluminum heat dissipater which cools LED elements 8*a*, 8*b*. Step section 40*c* is formed as a concave surface seen from any direction through 360° in the z direction of main plane plate 51. Step section 40*c* has a tapered section in the shape of Mt Fuji, and has a smooth outline.

Curved surface section 41*c* which forms the curved surface of step section 40*c* is polished to reflect light, and the surface of reflective surface 43*c* is polished so that it resembles a mirror. Curved surface 41*c* of step section 40*c* functions as a convex mirror.

The initial angle θ3 between concave surface section 41*c* of step section 40*c* and main plane plate 51 (z direction) is between 0° and 10°. Moreover, the initial angle θ4 between concave surface section 41*c* of step section 40*c* and LED board 3 (3*a*, 3*b*) (z direction) is between 90° and 100°. The angles between concave surface section 41*c* of step section 40*c* and main plane plate 51 (z direction) increase gradually from θ3 and thereafter rapidly increase so that they reach the angle θ4 between concave surface section 41*c* of step section 40*c* and LED board 3 (3*a*, 3*b*) (z direction.)

Translucent globe 10*c* is made of polycarbonate resin to which a light-diffusing agent has been added. Translucent globe 10*c* may be identical to translucent globe 10 described in Embodiment 1.

The light paths created by LED elements 8 (8*a*, 8*b*) positioned on the surfaces of LED board 3 (3*a*, 3*b*) in the embodiment are shown schematically in FIG. 5.

Light L4 emitted from LED element 8*a* arrives directly at translucent globe 10*c*, and is then shone out externally being diffused by the light-diffusing effect of translucent globe 10.

Light L5 emitted from LED element 8*b* arrives at concave surface section 41*c* of step section 40*c*, and is reflected by the concave mirror effect to form light path L51. L51 arrives at translucent globe 10*c* and is shone out externally, being diffused by the light-diffusing effect of translucent globe 10*c*.

Light L6 emitted from LED element 8*b* arrives at concave surface section 41*c* of step section 40*c*, forming light path L61 reflected by the concave mirror effect. L61 arrives at translucent globe 10*c*, and is shone out externally being diffused by the light-diffusing effect of translucent globe 10*c*.

Due to translucent globe (translucent globe 10*c*) with added light-diffusing agent and tapered step section 40*c* formed into a curved surface (concave surface), light from LED elements 8*a*, 8*b* positioned on both surfaces of LED board 3 (3*a*, 3*b*) forms the light paths shown in FIG. 5, realizing a light distribution of more than 180° and also enabling a greater light distribution in the z direction.

Lighting device 100*c* of the embodiment is characterized in that the tapered surface of the tapered step section is a curved surface. Thus with light device 100*c* of the embodiment the reflection of light by the curved surface (concave surface) of the tapered step section enables a greater distribution of light toward the plane.

Lighting device 100*c* of the embodiment is characterized by being made of metal which reflects light by being polished. Thus with lighting device 100*c* of the embodiment, having the step section made of metal which reflects light with a polished surface enables more light to be distributed both toward the board toward plane of the translucent globe.

Embodiments 1 and 2 have been described above, but the disclosure may be realized by combining these two embodiments. It may also be possible to partially embody either one of these two embodiments. Alternatively it may be possible to partially embody these two embodiments together.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

KEY TO DIAGRAMS

2 . . . light-diffusing film,
3, 3*a*, 3*b* . . . LED board,
7 . . . fitting,
8, 8*a*, 8*b* . . . LED element,
10, 10*c* . . . translucent globe,
11 . . . globe overhang section,
31 . . . light-emitting surface,
32 . . . non-light-emitting surface,
35 . . . board overhang section,
40, 40*c* . . . step section,
41 . . . tapered surface,
41*c* . . . concave surface section,
42 . . . reflective surface,
43 . . . light-diffusing film,
43*c* . . . reflective surface,
44 . . . board attachment surface,
45 . . . bottom section,
50 . . . lighting device main body,
51 . . . main plane plate,
60 . . . external surround,
61 . . . heat dissipater,
100, 100*c* . . . lighting device

The invention claimed is:

1. A lighting device, comprising:

a board having a front surface and a back surface, and a board attachment base provided with an attachment surface smaller than an area of the back surface, an opposing surface larger than an area of the attachment surface and which opposes the attachment surface, and a lateral surface which extends out from a periphery of the attachment surface towards a periphery of the opposing surface, wherein the lateral surface has a tapered shape, wherein the attachment surface of the board attachment base is arranged parallel to the back surface of the board, the board having a light source mounted in a section of the back surface region which is not abutted by the attachment surface, wherein the attachment surface, the opposing surface and the board are circular in shape and the attachment surface is attached across an entire diameter of the circular shape, a radius of the board having a length of between ½ and ¾ of the radius of the opposing surface, the attachment surface having an area between ¼ and 9/16 of an area of the back surface of the board, the area of the attachment surface defining a proportion of heat dissipation to light emitting surface on the board.

2. The lighting device as claimed in claim 1, wherein the attachment surface abuts a central region of the back surface, and the light source is mounted so as to surround the central region.

3. The lighting device as claimed in claim 1, further comprising a translucent globe which covers the board attachment base and the board attached to the board attachment base, the lateral surface of the board attachment base being a reflective surface which reflects the light emitted by the light source through the globe.

4. The lighting device as claimed in claim 3, wherein cross sections through surfaces parallel to the attachment surface are annular, the board being attached to the same surface as the maximum cross sectional diameter, this being the cross section through the globe having the largest diameter.

5. The lighting device as claimed in claim 1, an angle between the opposing surface and the lateral surface of the board attachment base is between 40° and 60°.

6. The lighting device as claimed in claim 1, the lateral surface of the board attachment base is a concave surface.

7. A lighting device, comprising:

a first board having a front surface and a back surface, a second board having a front surface and a back surface, the second board attached with its front surface to the back surface of the first board, and a board attachment base provided with an attachment surface smaller than an area of the back surface of the second board, an opposing surface larger than an area of the attachment surface and which opposes the attachment surface, and a lateral surface which extends out from a periphery of the attachment surface towards a periphery of the opposing surface, the second board having a light source mounted in a section of the back surface region which is not abutted by the attachment surface, wherein the attachment surface, the opposing surface and the second board are circular in shape and the attachment surface is attached across an entire diameter of the circular shape, a radius of the second board having a length of between ½ and ¾ of the radius of the opposing surface, the attachment surface having an area between ¼ and 9/16 of an area of the back surface of the second board, the area of the attachment surface defining a proportion of heat dissipation to light emitting surface on the second board.

* * * * *